US005794342A

United States Patent [19]

Davey

[11] Patent Number: 5,794,342

[45] Date of Patent: Aug. 18, 1998

[54] OSCILLATING BLADE RAZOR

[76] Inventor: Melville G. Davey, P. O. Box 212, Swansea, Mass. 02777

[21] Appl. No.: 694,829

[22] Filed: Aug. 9, 1996

[51] Int. Cl.[6] ..... B26B 21/40

[52] U.S. Cl. ..... 30/45; 30/43.42

[58] Field of Search ..... 32/45, 43.42, 43.41, 32/277.4

[56] References Cited

U.S. PATENT DOCUMENTS

| | | | |
|---|---|---|---|
| 1,759,981 | 5/1930 | Elzinga et al. | 30/45 |
| 3,631,595 | 1/1972 | Scott | 30/45 |
| 4,914,816 | 4/1990 | Fenn et al. | 30/45 |
| 5,007,169 | 4/1991 | Motta | 30/45 |
| 5,299,354 | 4/1994 | Metcalf et al. | 30/45 |

*Primary Examiner*—Douglas D. Watts

[57] ABSTRACT

An oscillating blade razor for removing hair projecting from skin is described. At least one cutting blade is mounted to a shuttle which is nested within a cartridge such that the shuttle is free to move in a longitudinal oscillating motion relative to the cartridge. The cartridge is removably affixed to the head of the razor in which is disposed a cantilever type bimorph piezoelectric motor, the proximal end of which is fixedly mounted in the head such that the distal end engages the shuttle and drives it in a reciprocating, oscillatory motion when the cartridge is engaged with the head and power applied. The head further incorporates the mechanism for engaging the cartridge. In one preferred embodiment, the cartridge incorporates electrical contact means for sensing the end travel of the oscillating shuttle. The head is disposed on the distal end of a handle which contains a battery, an on/off switch, and the electronic means for driving the distal end of the piezoelectric motor in an oscillatory motion. The proximal end of the handle provides a means for replacing the battery.

11 Claims, 6 Drawing Sheets

OSCILLATING BLADE RAZOR

BACKGROUND

1. Field of the Invention

The present invention relates to non cooperating blade devices for cutting and particularly to razors for removing hair protruding from skin of types often having disposable blades and a mechanism for causing the blades to vibrate.

2. Description of Prior Art

It is well known to anyone having carved a turkey at Thanksgiving dinner that some longitudinal motion of the knife is helpful in making the cut. This phenomenon in fact has given rise to several forms of reciprocating blade carving knives. A simplified explanation of this effect lies in the notion that no cutting edge is perfectly smooth nor comes to a perfect zero width. Therefore, any cutting action of a knife is enhanced with longitudinal motion by causing tearing and removal of material at some microscopic level in much the way, macroscopically, a saw cuts a log.

To this end, several schemes have been devised to provide reciprocating, vibrating, or oscillating motion to non cooperating blade razors used for shaving. Vincent Motta, U.S. Pat. No. 5,007,169 for instance describes a razor containing a rotary motor driven mechanism with eccentric coupling for imparting oscillatory movement to the cartridge. Lawrence Fenn, et al, U.S. Pat. No. 4,914,816 describe a rotary motor driven razor, the motor connected to an reciprocatory inducing weight. Steven C. Metcalf, U.S. Pat. No. 5,299,354 describes an oscillating shaver or wet shave razor having a rotary motor with an eccentric element for imparting oscillating motion. While each of these inventions addresses the problem of providing some degree of longitudinal blade motion to enhance the cutting action, none of them meet certain empirically determined requirements of an oscillating blade razor needed to provide the smooth close shaving action required by the marketplace. Each of them, for instance, impart at least some of the vibrating motion to the skin thereby reducing the motion imparted upon the hair. None of them are capable of the high rate of oscillation, empirically determined by this inventor, for effective cutting. A simple calculation demonstrates this requirement. The nominal speed at which a user moves a razor across the skin is of the order of 15 mm sec. It was determined that effective cutting occurs when longitudinal motion of the cutting edge is of the order of 10 times or greater the depth of cut. Therefore, given that a hair diameter is of the order of 0.12 mm, and that the longitudinal displacement of the cutting edge is of the same order, then the longitudinal oscillatory motion of the cutting edge should occur at least once every 0.8 milliseconds or at the rate of 1,250 Hertz. It is further speculated that this speed of action produces the added benefit of causing the cutting edge to operate against the inertia of the hair, giving rise to less compliance of the hair within the skin and therefore a more effective cutting action against the hair. Additionally, none of the prior art means lend themselves to the compact, low cost, light weight, energy efficient drive mechanism that is required of an effective oscillating blade razor.

SUMMARY OF THE INVENTION

Accordingly, an object of the present invention is to provide an effective means of shaving protruding hair from the skin, reducing pulling action, and providing a closer shave, by improving the cutting action of a blade using high speed longitudinal oscillatory motion of a non cooperating blade device.

It is a further object of the present invention to demonstrate a high speed oscillatory means for driving a cutting blade in the longitudinal axis.

It is a further object of the present invention to demonstrate a means of driving a cutting edge device in a high speed oscillatory motion for precise, delicate cutting.

A yet further object of the present invention is to provide a battery powered oscillating blade razor which is simple, light weight, energy efficient and adaptable to operation with disposable cartridges.

One preferred embodiment of the present invention is a non cooperating blade, shaving device commonly known as a wet razor. It comprises a blade oscillating means for causing longitudinal motion of a shuttle and its attached blade within a cartridge which is removable from a head and the attached handle of the razor.

The oscillating means is a cantilever mounted, bimorph piezoelectric vane, known as the motor. The term bimorph indicates that ceramic peizoelectric material is attached to both sides of a central vane. Single sided devices also work; just not as effectively. The ceramic piezoelectric material is polarized such that an applied charge causes the vane to bend along its longitudinal axis substantially normal to the plane of the vane. The motor is fixedly mounted at the proximal end with the plane of the vane normal to the longitudinal axis of motion, in the head of the razor, such that the distal end engages the shuttle when the cartridge is engaged with the head. This equates to a cantilever mount. A battery powered circuit consisting of an electronic flip flop and a clock signal generating means is used to provide suitable signals for driving the motor.

An alternate version of a first described blade cartridge is illustrated and described to demonstrate an improved model which may be more suitable for use in wet environments where soap and hair could possibly interfere over time with the closer tolerances needed for the first described cartridge. That is, the shuttle of the first described unit is constrained to movement in the longitudinal axis by the fit of the shuttle to a case. In the second described cartridge the shuttle is constrained to movement substantially in the longitudinal axis by mounting using a pair of parallel leaf springs. In this instance the shuttle can be substantially smaller than the case.

The above and other objects, features, aspects, and advantages of the present invention: will become more apparent from the following detailed description of the present invention when taken in conjunction with the accompanying drawings.

PART NUMBERS

20 Cartridge
21 Blade
22 Shuttle
23 Case
24 Slot
25 Tabs
26 Spring Clip
27 Ferrules
28 Shuttle Conductors
40 Head
41 Eject Button
42 Tines
43 Conductors
44 Enclosure Part
50 Motor
60 Handle
62 Switch
64 Battery
65 Cap
70 Drive circuit
71 Flip Flop
72 Resistor
80 Cartridge B
81 Leaf Springs
82 Shuttle B
83 Case B

DESCRIPTION OF THE PREFERRED EMBODIMENTS

Figure 1:
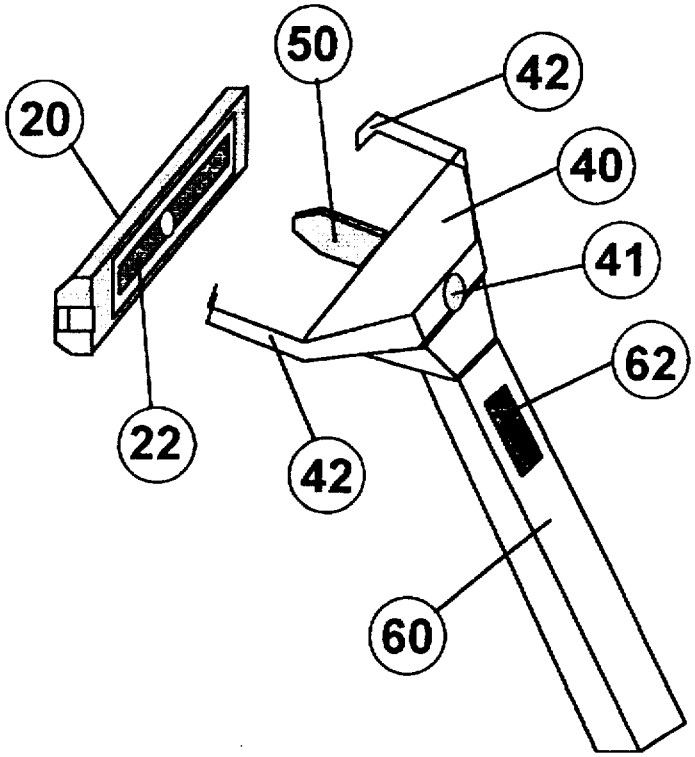
FIG. 1. An isometric line drawing of a razor of the current invention with cartridge detached.

FIG. 1 is an isometric line drawing of the razor with cartridge 20 and shuttle 22 disengaged from the head 40. Cartridge 20 is engaged by tines 42 of head 40 through the action of eject button 41. The motor 50 is shown with its proximal end mounted in head 40 leaving the distal end free to engage a slot in shuttle 22 when cartridge 20 is engaged on tines 42. Handle 60 incorporates the power on off switch 62 and electronic elements (shown in FIG. 4) and provides a user hand grip.

Figure 2A:
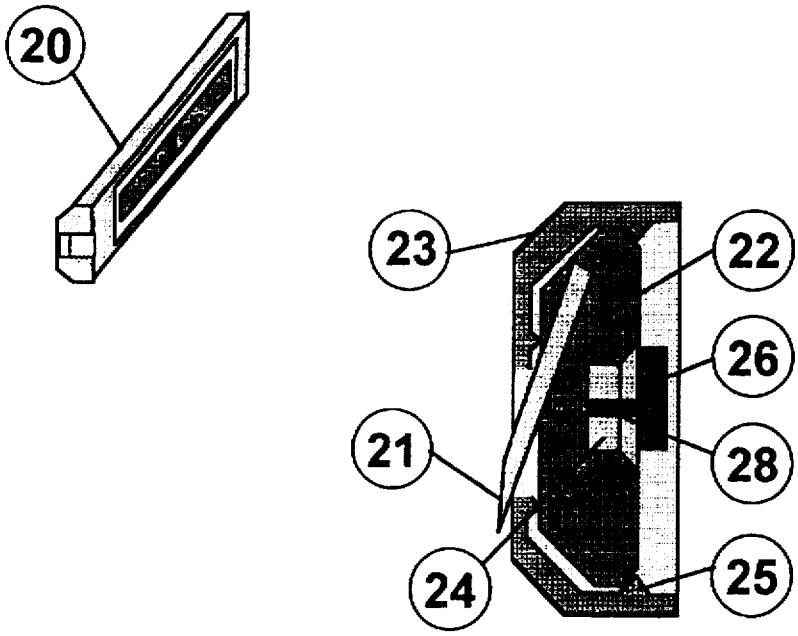
FIG. 2A. A cross section view through the center of one preferred embodiment of a cartridge.

FIG. 2A is a cross section view through the center of the cartridge 20. The cutting device, blade 21, is of the type generally found in disposable razor cartridges. It is the approximate length of, rigidly attached to, and disposed on shuttle 22 on a bias such that it extends slightly outside the distal plane, the skin contact surface, of cartridge 20 when assembled with case 23. The shuttle 22 is nested within case 23 and retained by tabs 25. Case 23 is dimensioned such that shuttle 22 is constrained to move longitudinally without restraint and substantially without movement in either of the other two axis. Positioned at each end of case 23 is a spring clip 26. Spring clips 26 are aligned to contact shuttle 22 at the ends of travel and compress during the extreme longitudinal excursions of the shuttle 22. Spring clips 26 are fastened in place with ferrules 27 (shown in FIG. 2B) so as to provide a metallic connection of spring clips 26 to the exterior end portions of case 23. Spring clips 26 serve the dual purpose of converting the kinetic energy of motion of shuttle 22 to stored potential energy and of providing a conductive electrical path for generating an "end of travel-"signal. The result is an energy efficient system for increasing the natural frequency of oscillation of the spring mass system formed by shuttle 22 and motor 50 (shown in FIG. 3). Shuttle 22 incorporates a slot 24 within the body for engaging the distal end of a cantilever mounted bimorph piezoelectric motor 50. Slot 24 is configured such that the tip of motor 50 engages the shuttle 22 along an axis formed by connecting the center lines of ferrules 27 and substantially without relative longitudinal motion and without restricting the bending action of motor 50.

Figure 2B:
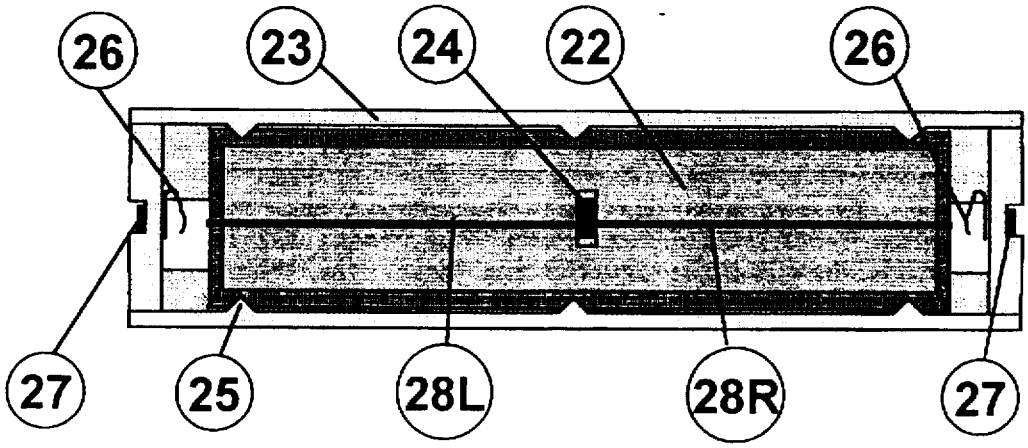
FIG. 2B. A plan view from the proximal face of the cartridge of FIG. 2A.

FIG. 2B is a plan view from the proximal plane of cartridge 20. The shuttle 22 is nested within case 23 and held in place with tabs 25 so as to allow longitudinal motion of the shuttle 22. Conductors 28L and 28R each run from their respective sides of slot 24 to the corresponding ends of shuttle 22 so as to make continuous metallic contact to the respective faces of motor 50 (shown in FIG. 3) when it is engaged in slot 24 and intermittent contact to spring clips 26 during the oscillating excursions of shuttle 22. Spring clips 26 are fastened in place with ferrules 27 so as to create a conductive path from spring clips 26 to the outside ends of case 23 and to tines 42 of head 40 when cartridge 20 is engageds.

Figure 3:
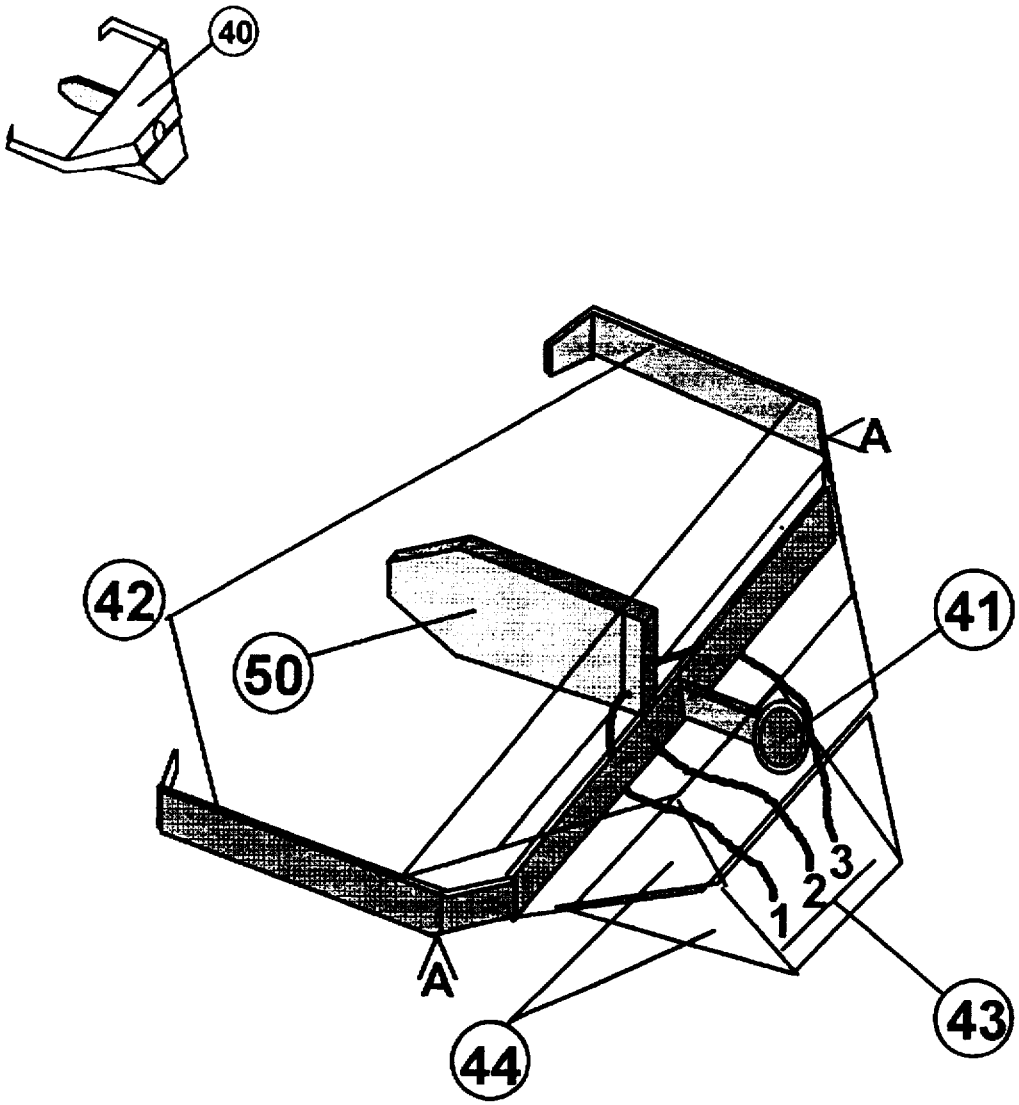
FIG. 3. A partially transparent line drawing of the head of one preferred embodiment of the razor.

FIG. 3 is a partially transparent line drawing of the head 40 portion of the razor. Enclosure parts 44 are suitably, configured, assembled plastic molded pieces serving to secure motor 50 at the proximal end, the tines 42 at the positions designated as "A", and handle 60 not shown at its distal end. Tines 42 are constructed of a metallic spring material and pivot slightly about positions "A" in FIG. 3 when bent along the proximal edge by the action of eject button 41. Thereby pressing on the button 41 causes tips "B" to separate. This separation of tips "B" allows cartridge 20 to be inserted between tips "B" and then secured to head 40 by releasing the pressure on eject button 41 allowing tips "B" to come together and insert into ferrules 27 of cartridge 20. Tines 42 are constructed from a single piece of spring conductive material and serve to create an electrical path from ferrules 27 of cartridge 20 to conductor 43-2. Tines 42 are substantially more rigid than any spring elements in cartridge 20 thereby maintaining cartridge 20 substantially fixed in the longitudinal axis relative to the head 40 and handle 60. Opposite faces of the cantilever mounted bimorph piezoelectric motor 50 are operationally connected to conductors 43-1 and 43-3 respectively. Conductors 43 are suitably terminated at the proximal end of head 40 to operationally engage drive circuitry 70 of handle 60 when handle 60 is assembled with part 44 of head 40.

Figure 4:
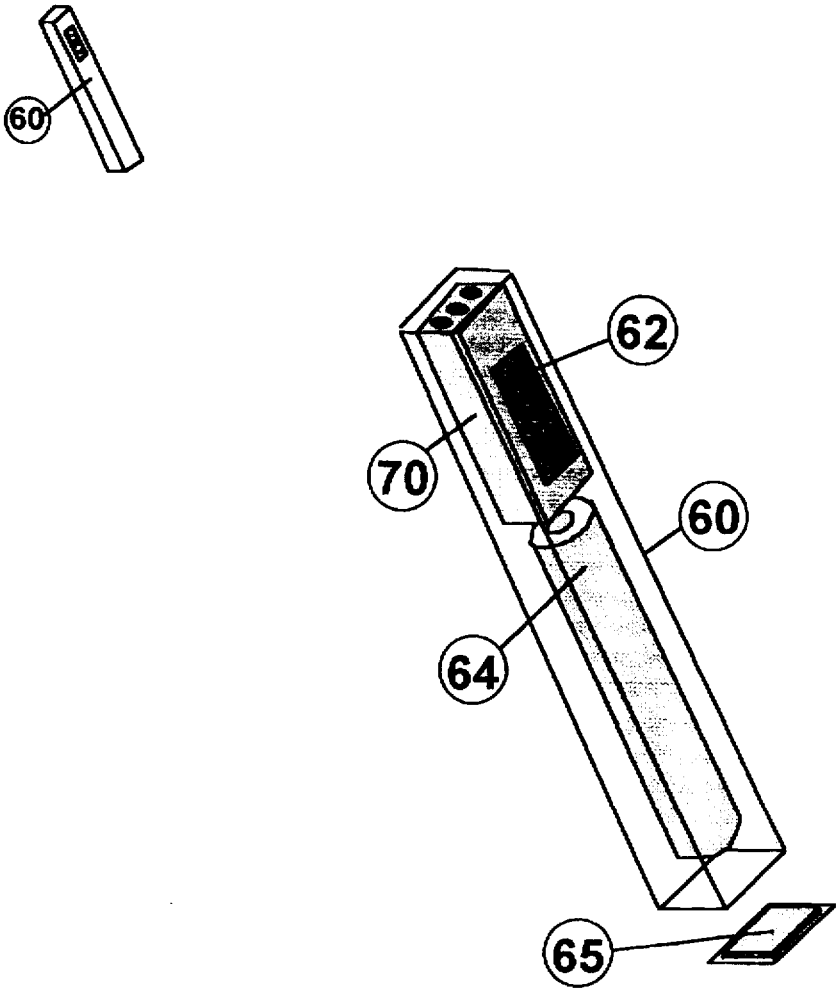
FIG. 4. A partially transparent line drawing of the handle of one preferred embodiment of the razor.

FIG. 4 is a partially transparent line drawing of handle 60 of the razor. Handle 60 is a suitably configured plastic molded piece providing interior space for drive circuit 70 and battery 64. The distal end of handle 60 is suitably configured to mate with part 44 of head 40 and provide operational connection between drive circuit 70 and conductors 43. Suitably located on handle 60 is a power on off switch 62 operationally connected between one pole of battery 64 and drive circuit 70. The opposite pole of battery 64 is operationally connected to drive circuit 70. A suitably configured cap 65 is provided for the proximal end of handle 60 to allow battery 64 replacement.

Figure 5:
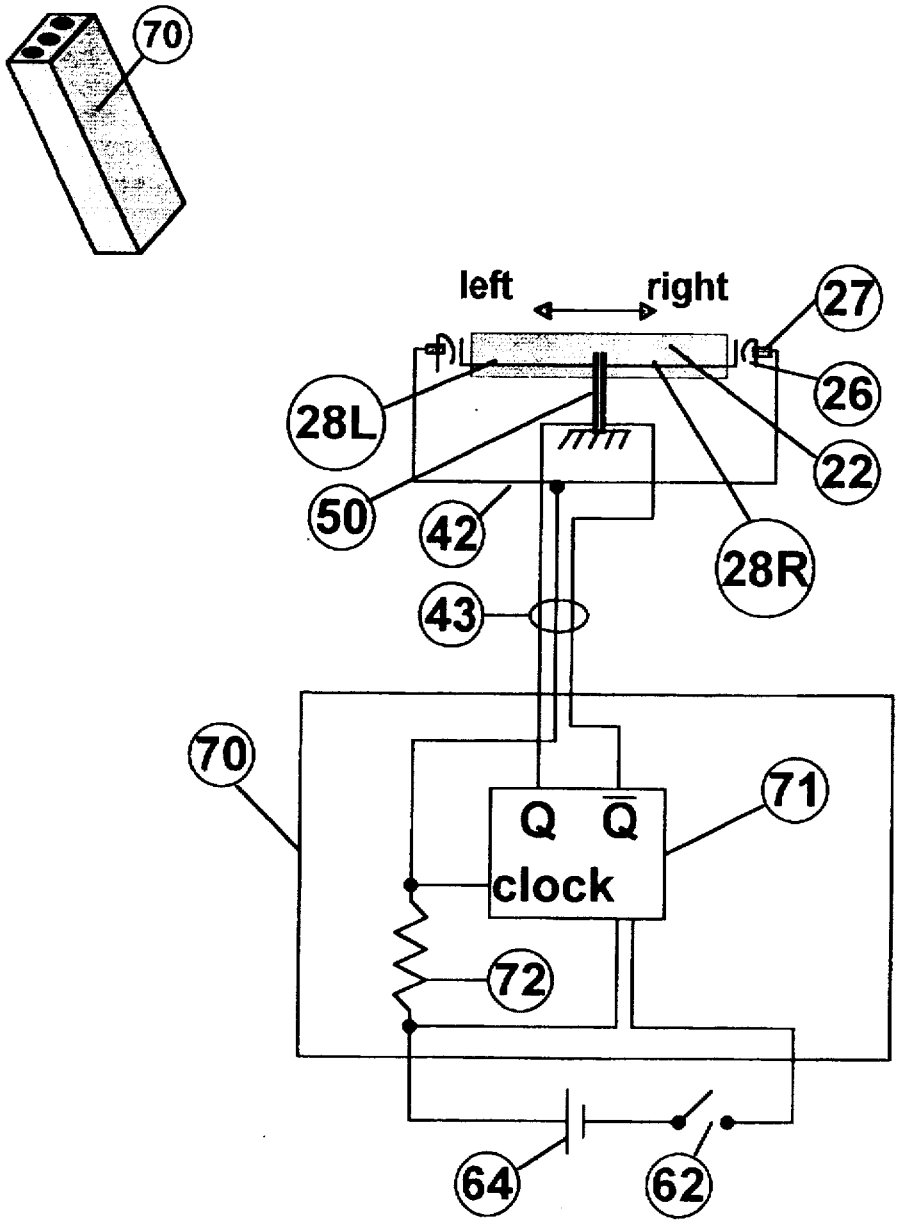
FIG. 5. An electronic schematic drawing of a drive circuit for a piezoelectric vane showing the relationship in a preferred embodiment of the electronic driving means and the mechanical means.

FIG. 5 is a schematic drawing of drive circuit 70 in operational relation to battery 64, switch 62, tines 42, shuttle conductors 28L and 28R, conductors 43, and motor 50. When switch 62 is closed, power from battery 64 is applied to flip flop 71 and a pull up resistor 72. Flip flop 71 is a standard electronic component known in the art and is configured to change state with a failing edge signal on the clock line. Initially when powered, the state of the "Q" line of flip flop 71 is high (that is: at the positive supply voltage level) and the state of the "$\overline{Q}$" is low (that is: at the negative supply voltage level or ground). Motor 50 always deflects away from the positive charge face and toward the negative charge face. Hence when initially powered via flip flop 71, motor 50 deflects to the right (per the right arrow in FIG. 5)

causing shuttle 22 and attached shuttle conductors 28 to travel to the right. At the extreme end of travel, shuttle conductor 28R contacts the right end spring clip 26 which via the right end ferrule 27 and tines 42 completes an electrical circuit to ground through the right (low) face of motor 50. This circuit completion causes the initially high clock line of flip flop 71, as pulled up by resistor 72, to go low causing flip flop 71 to change state. The state change causes motor 50 to deflect to the left moving shuttle 22 left and breaking the completed circuit formed via conductor 22R allowing the clock line to go high. When shuttle 22 reaches the extreme left end of travel, shuttle conductor 28L contacts the left end spring clip 26 which via the left end ferrule 27 and tines 42 completes a circuit to ground through the left (now the low) face of motor 50. This circuit completion causes the high clock line of flip flop 71, as pulled up by resistor 72, to go low causing flip flop 71 to change state. The state change causes motor 50 to deflect to the right moving shuttle 22 right and breaking the completed circuit formed via conductor 22L allowing the clock line to go high. The shuttle 22 continues to move right until the right side circuit is once again established causing the clock line to go low and once again causing flip flop 71 to change state. In this way, the end of travel signal remains synchronous with the motion of the shuttle 22. This repetitive process continues as long as power is applied through switch 62 resulting in the longitudinal oscillation of shuttle 22 and the attached blade 21

Figure 6:
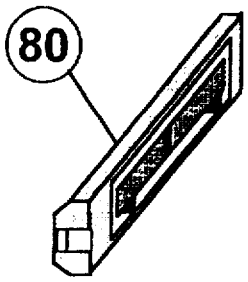
FIG. 6. A cross section and plan view of an alternate preferred embodiment of a cartridge.
Figure 6:
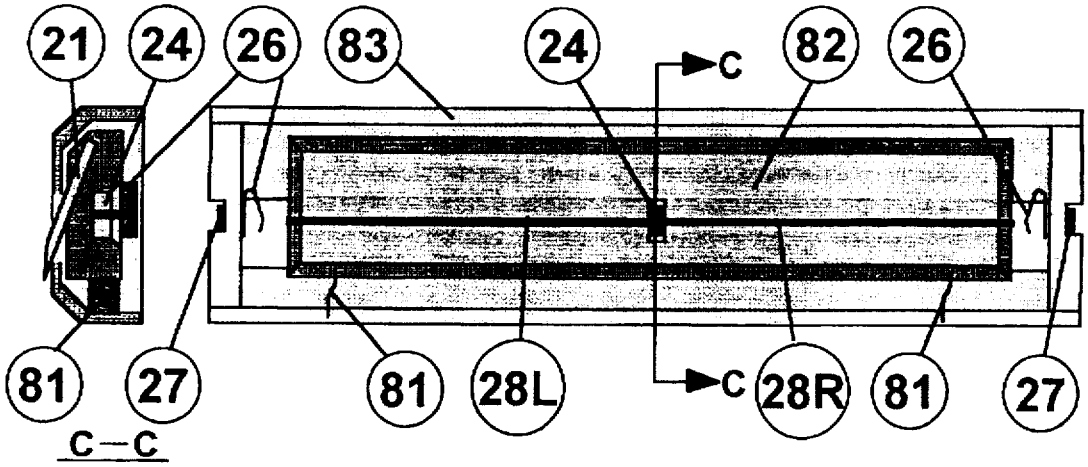

FIG. 6 is a plan view from the proximal plane of cartridge B 80 and section view of cartridge B 80. Cartridge B 80 is an alternate version of cartridge 20 in which shuttle 22 is replaced by the shuttle B 82 and case 23 is replaced by the case B 83. Shuttle B 82 is disposed within case B 83 and held in place with leaf springs 81 so as to allow longitudinal motion of the shuttle B 82. Conductors 28 each run from their respective sides of slot 24 to the corresponding ends of shuttle B 82 so as to make continuous metallic contact to the respective faces of motor 50 (shown in FIG. 3) when it is engaged in slot 24 and intermittent contact to spring clips 26 during the oscillating excursions of shuttle B 82. Spring clips 26 are fastened in place with ferrules 27 so as to create a conductive path from spring clips 26 to the outside ends of case B 83 and to tines 42 of head 40 when cartridge 20 is engaged. Leaf springs 81 are longitudinally separated and fixedly secured along each end of the springs 81 to case B 83 and the corresponding positions in shuttle B 82 respectively. The faces of the springs 81 are aligned normal to the longitudinal axis of shuttle B 82. The springs 81 are rectangular in shape and can be constructed of any suitable spring material. Additionally, while the springs 81 are shown as individual entities, they can be constructed in plastic as integral parts of case B 83 and shuttle B 82 by a molding process.

While the above description has been made mainly with reference to a razor of the type normally used in shaving, the present invention is also applicable to other cutting instruments such as surgical knives and similar delicate cutting devices. It, for instance, would be a natural variation of the above described invention to extend the blade longitudinally beyond the end of the shuttle and cartridge and reconfigure the head and handle to lie parallel to the longitudinal axis of the blade there-by producing a type of scalpel.

Although the present invention has been described and illustrated in detail, it is clearly understood that the same is by way of illustration and example only and is not to be taken by way of limitation, the spirit and scope of the present invention being limited only by the terms of the appended claims. CLAIMS

I claim:

1. A razor comprising a cartridge comprising a case, a shuttle and, at least one cutting blade attached to and aligned longitudinally with said shuttle, said shuttle disposed within said case and constrained to movement substantially in the longitudinal axis, a head including a cartridge engaging means and a cantilever mounted piezoelectric vane positioned such that the distal end of said piezoelectric vane engages said shuttle when said cartridge is engaged with said head, and a handle attached to said head, said handle comprising a piezoelectric vane electronic driving means, a battery for powering said electronic driving means, and an on off switch.

2. The razor of claim 1 wherein said cartridge further comprises means for producing an electrical signal corresponding to each end of longitudinal travel of said shuttle and means for storing the kinetic energy of longitudinal motion of said shuttle.

3. The cartridge of claim 2 wherein said means for storing the kinetic energy of longitudinal motion of said shuttle comprise spring clips attached to the inside ends of the said case containing said shuttle and aligned with the longitudinal axis of said shuttle such that one of said spring clips contacts a corresponding end of said shuttle at each end of travel of said shuttle, thereby compressing said spring clip, and said means for producing an electrical signal corresponding to the end of longitudinal travel of said shuttle comprise conductive means contacting separately each face of said piezoelectric vane, said conductive means routed to the corresponding ends of said shuttle, and further comprising, said spring clips in an electronically conductive relation to said cartridge engaging means, the entirety providing an electronically complete path between alternate faces of said piezoelectric vane and said cartridge engaging means at each end of travel of said shuttle.

4. The cartridge of claim 3 wherein said case containing said shuttle further comprises two or leaf springs longitudinally separated and fixedly secured along each of the ends, respectively to said case and to the corresponding positions along said shuttle, the faces of said leaf springs being aligned normal to the longitudinal axis of said shuttle, thereby providing constraint and alignment of said shuttle within said case while allowing longitudinal motion of said shuttle.

5. A means for driving a cutting blade in an oscillating longitudinal motion comprising a shuttle for mounting said blade said shuttle constrained to move substantially longitudinally within a case and further comprising a cantilever mounted piezoelectric vane having a proximal end fixed in relation to said case and a distal end engaging said shuttle further comprising an electronic means for driving said piezoelectric vane in an oscillatory mode such that said piezoelectric vane distal end is deflected in the longitudinal axis of said shuttle, substantially normal to the plane of a face of said piezoelectric vane and along a central axis connecting said proximal end and said distal end.

6. Claim 5 further comprising an electronic end of travel, signal producing means, in operative relation to said electronic means for driving said piezoelectric vane, said end of travel signals causing the electronic driving means to produce piezoelectric vane driving signals synchronously with the motion of said shuttle.

7. Claim 5 further comprising spring means for converting the end of travel kinetic energy of said shuttle to mechanical potential energy, release of said mechanical potential energy occurring naturally, synchronous with the reverse motion of said shuttle.

8. In a razor for shaving, having a vibrator means, a switch means, and a power means, the improvement being, a cartridge comprising a case and having disposed within, a shuttle constrained to substantially longitudinal motion, having affixed thereto, along the longitudinal axis, a cutting blade, a piezoelectric vane, cantilever mounted at a proximal end without motion relative to said case, having a distal end engaged with said shuttle such that motion of said distal end imparts a like motion to said shuttle, and an electronic driving means for providing drive signals to said piezoelectric vane.

9. The razor of claim 8, wherein said electronic driving means is in operative relation to an end of travel signal producing means for controlling the state of said electronic driving means synchronously with the motion of said shuttle.

10. The razor of claim 8, further comprising energy storage means for storing the kinetic energy of motion of said shuttle wherein said energy storage means comprises one or more springs attached to the inside ends of the said case containing said shuttle and aligned with the longitudinal axis of said shuttle such that one of said springs contacts a corresponding end of said shuttle at each end of travel of said shuttle thereby compressing said spring.

11. The razor of claim 8, wherein said case containing said shuttle, comprises two or more leaf springs longitudinally separated and fixedly secured along each of their respective ends, to said case and to the corresponding positions along said shuttle, the faces of said leaf springs being aligned normal to the longitudinal axis of said shuttle, thereby providing constraint and alignment of said shuttle within said case while allowing Longitudinal motion of said shuttle.

* * * * *